United States Patent [19]

Mikhlin et al.

[11] Patent Number: 4,874,393

[45] Date of Patent: Oct. 17, 1989

[54] METHOD OF PRODUCING FUEL OF RELATIVELY HIGHER CALORIFIC VALUE FROM LOW RANK AND OXIDIZED COAL

[75] Inventors: Josef A. Mikhlin, Montreal; C. Edward Capes, Ottawa; Haresh S. Divanji, Montreal; Richard D. Coleman, Orleans, all of Canada

[73] Assignee: Canadian Patent and Development Ltd., Ottawa, Canada

[21] Appl. No.: 67,111

[22] Filed: Jun. 29, 1987

[30] Foreign Application Priority Data

Jul. 4, 1986 [CA] Canada ..... 513,163

[51] Int. Cl.[4] ..... B01J 2/06; C01L 9/10

[52] U.S. Cl. ..... 44/20; 44/608; 44/627; 208/426; 264/117

[58] Field of Search ..... 44/1 R, 51, 20, 608, 44/627; 208/426, 435; 264/117

[56] References Cited

U.S. PATENT DOCUMENTS

| | | | |
|---|---|---|---|
| 3,998,604 | 12/1976 | Hinkley | 44/1 R |
| 4,029,507 | 6/1977 | Farnard et al. | 208/426 X |
| 4,057,486 | 11/1977 | Meadus et al. | 208/426 X |
| 4,121,910 | 10/1978 | Stambaugh | 208/426 X |
| 4,239,718 | 12/1980 | Dudt | 208/426 X |
| 4,309,270 | 1/1982 | Tyler et al. | 208/426 X |
| 4,601,729 | 7/1986 | Capes et al. | 44/1 R X |

*Primary Examiner*—Glenn Caldarola

*Attorney, Agent, or Firm*—Juliusz Szereszewski

[57] ABSTRACT

Low-rank or oxidized coal is processed to produce fuel of relatively higher calorific value by conditioning a slurry of the coal with an electrolyte, and then agglomerating the carbonaceous portion of the coal using a coal derived agglomerating oil. Agglomerates may be first formed in a high shear mixer and then larger agglomerates formed in a low speed mixer. The agglomerates may be processed in a coal liquefaction plant and a portion of the coal derived oil produced in the plant used as the agglomerating oil.

2 Claims, 2 Drawing Sheets

METHOD OF PRODUCING FUEL OF RELATIVELY HIGHER CALORIFIC VALUE FROM LOW RANK AND OXIDIZED COAL

This invention relates to a method of producing fuel of relatively higher calorific value from low-rank and oxidized coal.

It is known from, for example, "Physical Cleaning of Coal, Present and Developing Methods", edited by Y. A. Liu, 1982, "Selective Oil Agglomeration in Fine Coal Beneficiation", C. E. Capes and R. J. Germain, page 318, that lower-rank sub-bituminous coals, lignite, weathered high rank coals and other difficult to agglomerate coals are distinguished from other coals by their greater oxygen content and the hydrophilic nature of their surfaces relative to those of bituminous coals. The light oils which are used successfully to agglomerate the carbonaceous portions of bituminous coals are not able to wet the oxidized and/or hydrated carbonaceous portions of lower-rank coals and so form only emulsions with no discrete agglomerates when agitated with them in a water slurry. If heavier oils, such as coke oven tars and pitches as well as petroleum crudes and their higher boiling components, are used as conditioners with the light oils, however, then distinct agglomerates are formed with the lower-rank coals. Apparently the nitrogen, oxygen and sulfur functional groups of these complex oils are able to adsorb sufficiently well on the relatively hydrophilic surfaces of the lower-rank coals to form agglomerates.

Ash rejection does occur when the heavier, complex oils containing multiple functional groups are used as conditioning agents. However, the amount of ash rejection is less than that might be expected if the lighter, more refined oils alone could be used for agglomeration. The procedure also produces a granular material from which a large portion of the surface moisture has been displaced. Unfortunately, the treatment is not able to reduce the internal moisture bound within the structure of the lower-rank coals without thermal drying. The consistent granular texture of the product is well suited to rapid thermal drying and the absorbed oil in the agglomerates reduces considerably the readsorption of moisture following thermal drying.

A similar problem exists with other difficult to oil agglomerate coals such as oxidized (weathered) high-rank bituminous coals, for example, finely divided carbonaceous particles which have become oxidized or weathered in black-water ponds.

There is a need for a process whereby low-rank and oxidized coals can readily be treated to produce a fuel therefrom of relatively higher calorific value.

According to the present invention there is provided a method of producing fuel of relatively higher calorific value from low-rank and oxidized coal, comprising:

(a) agitating to thoroughly mix electrolyte selected from the group consisting of concentrated sulphuric acid, concentrated hydrochloric acid and sulphur trioxide gas", with an aqueous slurry of the coal comminuted to the ash release particle size "essentially smaller than 35 mesh Tyler Standard Screen", to condition the coal slurry for oil agglomeration of the carbonaceous portion of the coal therein by a coal derived oil; then (b) adding coal derived agglomerating oil to the conditioned coal slurry, the coal slurry containing about 10 to about 40 wt % oil, and about 0.5 to about 5.0 vol % electrolyte; then (c) agitating the mixture of coal derived agglomerating oil and conditioned coal slurry to form agglomerates of carbonaceous material of the coal in the mixture, the agglomerates containing about 10 to about 50 wt % coal derived oil; then (d) separating the agglomerates from the remainder of the mixture, and then (e) washing the separated agglomerates with water.

The mixture of coal derived agglomerating oil and conditioned coal slurry are preferably agitated at a mixing rate in the range of about 0.1 hp/ft$^3$ to about 6.0 hp/ft$^3$ to form agglomerates of carbonaceous material of the coal in the mixture.

Better still, the mixture of coal derived agglomerating oil and conditioned coal slurry are agitated at a mixing rate in the range of about 0.4 hp/ft$^3$ to about 4.0 hp/ft$^3$ to form agglomerates of carbonaceous material of the coal in the mixture.

Still better results may be obtained if the mixture containing agglomerates is further agitated at a relatively slower mixing rate in the range of about 0.05 hp/ft$^3$ to about 0.5 hp/ft$^3$ to form relatively larger agglomerates of carbonaceous material.

The electrolyte may comprise a substance selected from the group consisting of concentrated sulphuric acid, concentrated hydrochloric acid and sulphur trioxide gas.

In some embodiments of the present invention, finely divided carbonaceous coal solids are mixed by further agitation, with the mixture containing agglomerates to form even larger agglomerates from the carbonaceous material of the coal.

A binder for carbonaceous material of the coal may be added to the conditioned coal slurry to assist in the formation of agglomerates of carbonaceous material of coal therein.

The agglomerates may be processed in a coal liquefaction plant, and a portion of the coal liquefaction oil product from the coal liquefaction plant is used to provide the coal derived agglomerating oil. The agglomerates may be slurried with a portion of the coal liquefaction oil product before being processed in the coal liquefaction plant.

In the accompanying drawings which illustrate, by way of example, embodiments of the present invention:

BRIEF DESCRIPTION OF THE DRAWINGS

Referring now to FIG. 1 there is generally shown a conditioning vessel 1, a first agglomerating vessel 2, a second agglomerating vessel 4, a draining screen 6 and a washing screen 8.

Figure 1:
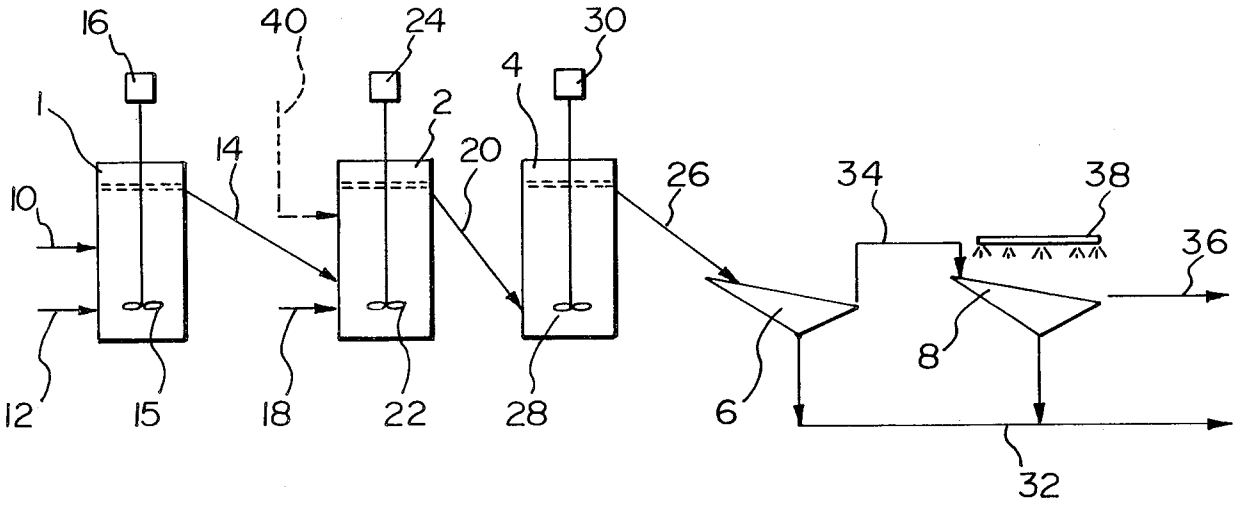
FIG. 1 is a diagram of an apparatus for producing a coal fuel of relatively higher calorific value from low-rank and oxidized coal.

The conditioning vessel 1 has an aqueous coal slurry inlet connected to a feed pipe 10, an electrolyte inlet connected to a feed pipe 12 and a slurry outlet connected to slurry pipe 14. The mixing vessel, has a stirrer 15 coupled to an electric motor 16.

The first agglomerating vessel 2 has an inlet connected to the pipe 14, an agglomerating oil inlet connected to a feed pipe 18 and an agglomerate, inorganic matter (ash) and water outlet 20. The first agglomerating vessel 2 has a high shear mixing device 22 coupled to an electric motor 24.

The second agglomerating vessel 4 has an inlet connected to the outlet 20 and an agglomerated, inorganic matter (ash) and water outlet connected to a conveyor 26. The second agglomerating vessel 4 has an intermediate intensity mixing device 28 coupled to an electric motor 30 for operation at a relatively lower blade speed than that of the high shear mixing device 22.

The draining screen 6 has a feed end for receiving agglomerates, inorganic matter (ash) and water from the conveyor 26, a drainage outlet connected to a pipe 32 and an agglomerate exit end for delivering agglomerates to a conveyor 34.

The washing screen 8 has an agglomerate receiving end for receiving agglomerates from the conveyor 34, a drainage outlet connected to the pipe 32, and an agglomerate exit end for delivering agglomerates to a conveyor 36. A washing water spray device 38 is situated over the washing screen 8 for spraying agglomerates thereon with washing water.

In operation, an aqueous coal slurry of low-rank or oxidized coal is fed to the conditioning vessel 1 along the feed pipe 10, and electrolyte is fed into the conditioning vessel 1 along the feed pipe 12. The aqueous coal slurry and the electrolyte are thoroughly mixed in the conditioning vessel 1 by the stirrer 15 coupled to the electric motor 16 to condition the carbonaceous portion of the coal slurry for oil agglomeration by rendering it more oleophilic. The conditioned coal slurry is then passed along the slurry pipe 14 to the first agglomerating vessel 2.

Coal derived agglomerating oil is fed to the first agglomerating vessel 2 along feed pipe 18.

The coal derived agglomerating oil and the conditioned coal slurry are vigorously mixed in the first agglomerating vessel 2 by the high shear mixing device 22 to form agglomerates of carbonaceous material of the coal in the remainder of the mixture (inorganic matter and water). These agglomerates could be separated from the remainder of the mixture as a useful product. However, in this embodiment the agglomerates, together with the remainder (inorganic matter and water) of the mixture are fed along pipe 20 to the second agglomerating vessel 4.

The agglomerates and the remainder (inorganic matter and water) of the mixture are agitated in the second agglomerating vessel 4 by the intermediate intensity mixing device 28 at a relatively lower blade speed than that of the high shear mixing device 22 until larger agglomerates are formed than those that were originally present.

The larger agglomerates and the remainder (inorganic matter and water) are passed from the second agglomerating vessel 4 to the conveyor 26 which conveys them to the draining screen 6.

The agglomerates with the remainder of the mixture (inorganic material and water) drained therefrom pass across the screen 6 to the conveyor 34 while the remainder is passed to the pipe 32.

The agglomerates are conveyed by the conveyor 34 to the washing screen 8. As the agglomerates pass across the washing screen 8 they are washed by water from the spray device 38 to wash trapped inoragnic solids therefrom. The washed agglomerates are passed from the washing screen 8 to the conveyor 36 while the inorganic solids (ash, clay, gangue) and washing water are passed to the pipe 32.

The agglomerates on the conveyor 36 may be used in, for example, fluidized or pulverized coal combustion, coal gasification, coal liquefaction, coal pyrolysis, coal/liquid fuel mixtures, coal/liquid pipeline mixtures. Clearly, since the agglomerating oil is a coal derived oil, using the agglomerates in a process that will derive such an oil from them will also provide a source of the agglomerating oil.

It should be noted that while two agglomerating vessels 2 and 4 are shown in FIG. 1, and that this is the preferred embodiment, it is within the scope of the present invention to use any number of agglomerating vessels from one upwards. In some embodiments of the present invention, a common mixing and agglomerating vessel is used in which the coal slurry and electrolyte are first mixed and then the coal derived oil is mixed and the agglomeration is carried out, but in this case the system of necessity operates intermittently on a batch system.

In some embodiments of the present invention, where handling of the agglomerates requires increased strength, a binder for the carbonaceous portion of the coal is fed to the agglomerating vessel 2 along a feed pipe 40 (shown dotted).

In tests to verify the present invention, using the apparatus shown in FIG. 1, it has been found that attempting to agglomerate the finely divided carbonaceous portion of low-rank or oxidized coal from an aqueous slurry having from about 10 weight percent to about 40 weight percent solids, the solids comprising the finely divided carbonaceous solids of low-rank or oxidized coal and finely divided inorganic solids, by mixing the slurry with oil in an amount sufficient to produce agglomerates of the carbonaceous solids containing from about 10 weight percent oil to about 50 weight percent oil and thereafter recovering the agglomerates as a product, in many instances the carbonacous solids of low-rank or oxidized coal are not agglomerated by such treatment. However, these non-agglomerating carbonaceous solids are readily agglomerated and recovered by mixing as a conditioning agent about 0.5 volume percent to about 5.0 volume percent of an electrolyte, such as concentrated sulphuric acid, concentrated hydrochloric acid or sulphur trioxide gas, with the aqueous slurry and then adding coal derived oil to it and agitating the mixture to produce agglomerates. Agglomerates are produced in a consistent and reliable manner containing from about 10 weight percent to about 50 weight percent of the oil. In instances where handling of the agglomerates produced would require increased strength it was found that mixing an agglomerate strengthening agent such, as, for example, oleic acid or cresylic acids or creosote oil, or pine oil, or di-n-propyl ketone or 1-hexanol, or sodium oleate, or naphthenic acid, or naphthylacetic and cyanamide or the like to the aqueous slurry, containing the said agglomerates of carbonaceous solids of low-rank coal or oxidized coal with oil and inorganic solids, readily produced the stronger agglomerates required for such handling.

In the tests, Onakawana lignite from Ontario, Canada, was used with mineral contents varying from about 16 to about 32 wt % dry basis in a aqueous slurry containing about 10 to about 15 wt % solids.

Suitable agglomerating oils are tar extracts and other oils derived from coal. Mixing rates range from about 0.1 hp/ft$^3$ to about 6.0 hp/ft$^3$ were used in the vessels 1 and 2. The optimum degree of agitation is variable depending upon the particular solids being subjected to agglomeration, the types of coal derived oil used and the like, with values from about 0.4 hp/ft$^3$ to about 4.0 hp/ft$^3$ being common. Normally, a colour change occurs in the mixture in agglomerating vessel 2 when the carbonaceous portion of the coal becomes coated with the coal derived agglomerating oil i.e., the bulk of the coal derived agglomerating oil is transferred from the aqueous medium to coat the carbonaceous portion of the coal and so the presence of oil is no longer observed in the vessel 2, although such a general rule of thumb is subject to qualification where an excessive amount of agglomerating oil is used.

In the second agglomerating vessel 4 lower rates of agitation from about 0.1 hp/ft$^3$ to 0.5 hp/ft$^3$ were used. The particle size of the coal solids charged to the vessel 1, were typically small, i.e., essentially smaller than 35 mesh Tyler Standard Screen (Sieve No. 40 in the U.S. Sieve Series) and preferably essentially smaller than 65 mesh Tyler Standard Screen (Sieve No. 70 in U.S. Sieve Series). For the tests the results of which are given in the following Table 1, in example 1, the particle sizes were in the range of minus 200 mesh plus 250 mesh Tyler Standard Screen (minus 200 plus 230 in U.S. Sieve Series); in examples 2 and 3, minus 65 mesh plus 200 mesh Tyler Standard Screen, (minus 70 plus 200 in U.S. Sieve Series); and in example 4 the particle sizes were smaller than minus 65 mesh Tyler Standard Screen (minus 70 in U.S. Sieve Series). Larger particles can, of course, be included depending on dissemination of ash (mineral matter) in the coal.

TABLE 1

| | | | CONDITIONS | | | | | | RESULTS | |
|---|---|---|---|---|---|---|---|---|---|---|
| | | | AGGLOMERATING OIL | | BINDER | | ELECTROLYTE | | | |
| TEST NO. | COAL USED | ASH (MINERAL) CONTENT WT. % IN DRY COAL | Coal Derived Agglomerating Oil Used | Amount WT % on Dry Solids | Binder Used | Amount WT. % on Dry Solids | Electrolyte Used | Amount Vol. % in Slurry | Carbonaceous Recovery Percent in Agglomerates | Change in Mineral Content from Coal to Agglomerates WT. % |
| 1 | Onakawana Lignite | 31.9 | Anthracene Oil | 22 | None | None | HCL | 1.28 | 95 | 48 |
| 2 | Onakawana Lignite | 16.6 | Anthracene Oil | 18 | Cresylic Acid | 1.46 | $H_2SO_4$ | 0.58 | 93 | 54 |
| 3 | Onakawana Lignite | 21.5 | Coal-Derived Heavier Distillate | 28 | Oleic Acid | 0.45 | $H_2SO_4$ | 0.64 | 97 | 58 |
| 4 | Onakawana Lignite | 25.4 | Coal-Derived Heavier Distillate | 36 | Cresylic Acid | 1.59 | $H_2SO_4$ | 0.77 | 99 | 56 |

Figure 2:
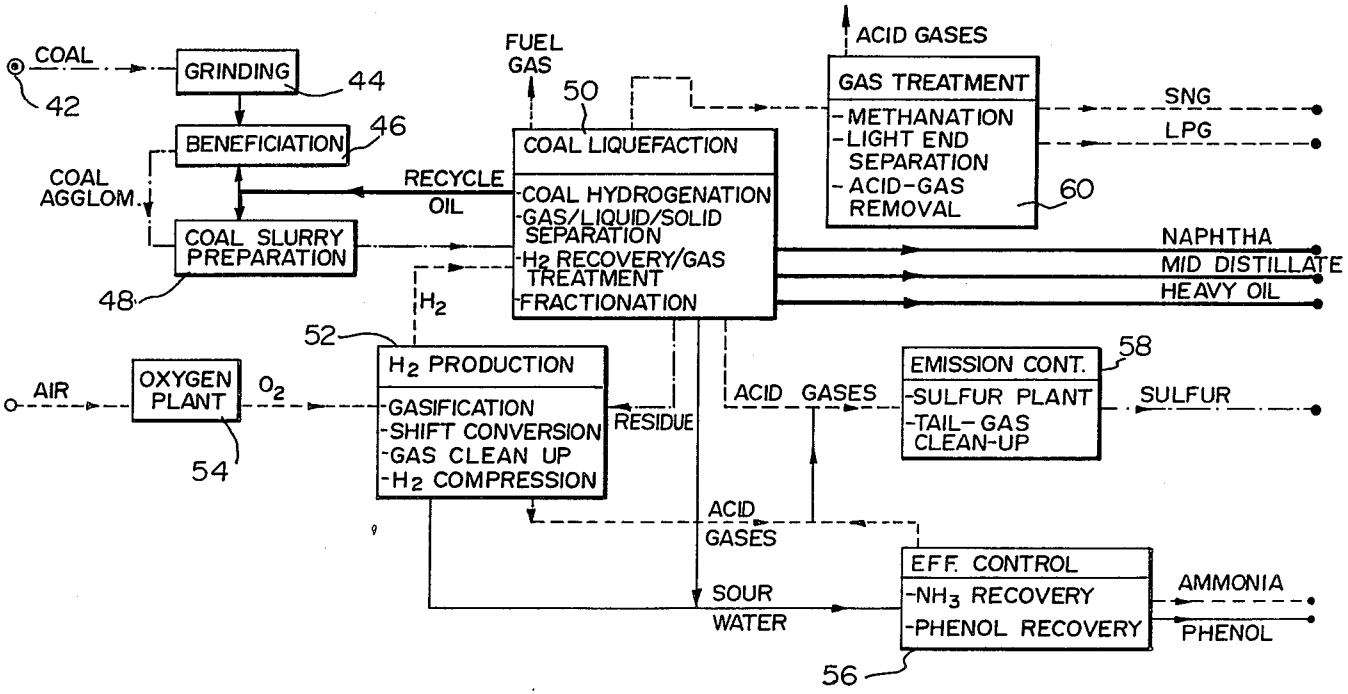
FIG. 2 is a flow diagram of an apparatus for producing coal liquefaction fuel of relatively higher calorific value from low-rank and oxidized coal.

Referring now to FIG. 2, there is shown a flow diagram wherein oxidized coal from a source 42 is ground and conditioned as a slurry with an electrolyte at 44, the conditioned slurry is then agglomerated with coal derived agglomerating oil at 46. The coal agglomerates from 46 are formed into a coal/oil slurry at 48 and the coal/oil slurry is fed to a coal liquefaction plant at 50. At 50 the coal is subjected to hydrogenation and the resulting gases, oils and coal solids residues are separated, and the oil is fractionated.

The hydrogen gas supply for the hydrogenation is derived from gaseous $H_2$ production at 52 which receives gaseous $O_2$ from 54 where oxygen is derived from air. At 52, gasification, shift conversion, gas clean up and $H_2$ compression takes place, while residue produced by coal liquefaction is fed thereto.

A portion of the coal derived oil produced at step 50 is used at step 46 as agglomerating oil and another portion is used at step 48 for slurring the agglomerates. At step 50 coal hydrogenation, gas/liquid/solid separation, $H_2$ recovery and gas treatment, and fractionation occurs, giving as products naphtha, mid-distillate and heavy oil.

Sour water from both the coal liquefaction step 50 and the $H_2$ production step 52 are fed for effluent control to an effluent treatment step 56 where $NH_3$ recovery and phenol recovery is effected.

Acid gases from the coal liquefaction step 50, the $H_2$ production step 52 and the effluent treatment step 56 are fed to an emission control step 58 where sulphur is extracted and tail-gas clean-up occurs.

Gases from the coal liquefaction treatment step are treated at step 60 by methanation, light end separation, and acid-gas removal to produce synthetic natural gas and liquefied petroleum gas leaving an acid gas residue.

We claim:

1. A method of producing fuel of relatively higher calorific value from low-rank and oxidized coal, comprising;

(a) agitating to thoroughly mix electrolyte selected from the group consisting of concentrated sulphuric acid, concentrated hydrochloric acid and sulphur trioxide gas with an aqueous slurry of the coal comminuted to an ash release particle size essentially smaller than 35 mesh Tyler Standard Screen, to condition the coal slurry for oil agglomeration of the carbonaceous portion of the coal therein by a coal derived oil; then (b) adding coal derived agglomerating oil to the conditioned coal slurry, the coal slurry containing about 10 to about 40 wt% oil, and about 0.5 to about 5.0 vol % electrolyte; then (c) agitating the mixture of coal derived agglomerating oil and conditioned coal slurry to form agglomerates of carbonaceous material of the coal in the mixture, the agglomerates containing about 10 to about 50 wt %, coal derived oil; then (d) separating the agglomerates from the remainder of the mixture; and then (e) washing the separated agglomerates with water.

2. A method according to claim 1, wherein a binder for carbonaceous material of the coal is added to the mixture to assist in the formation of agglomerates of carbonaceous material of coal therein.

* * * * *